US007325557B2

(12) United States Patent
Wallace, III

(10) Patent No.: US 7,325,557 B2
(45) Date of Patent: Feb. 5, 2008

(54) ROLLER AND PAINTBRUSH CLEANING KIT

(76) Inventor: Millard F. Wallace, III, 302 Laurelwood Dr., Douglasville, PA (US) 19518

( * ) Notice: Subject to any disclaimer, the term of this patent is extended or adjusted under 35 U.S.C. 154(b) by 639 days.

(21) Appl. No.: 10/840,788

(22) Filed: May 6, 2004

(65) Prior Publication Data

US 2004/0206380 A1 Oct. 21, 2004

Related U.S. Application Data

(63) Continuation-in-part of application No. 10/370,899, filed on Feb. 20, 2003, now abandoned.

(60) Provisional application No. 60/359,211, filed on Feb. 21, 2002.

(51) Int. Cl.
*B08B 3/00* (2006.01)

(52) U.S. Cl. ..... 134/900; 134/198; 134/137; 134/104.2

(58) Field of Classification Search ..... 134/900, 134/198, 104.2, 137
See application file for complete search history.

(56) References Cited

U.S. PATENT DOCUMENTS

| | | | | |
|---|---|---|---|---|
| 3,730,195 | A | 5/1973 | Kay | |
| 4,011,622 | A | 3/1977 | Gillum et al. | |
| 4,108,189 | A | 8/1978 | Claiborne et al. | |
| 4,667,363 | A | 5/1987 | Calvert | |
| 4,700,728 | A | 10/1987 | Patterson | |
| 4,765,353 | A | 8/1988 | Rhoades | |
| 5,095,928 | A | 3/1992 | Phipps | |
| 5,238,012 | A * | 8/1993 | Coronato | 134/140 |
| 5,363,869 | A | 11/1994 | McDowell | |
| 5,614,021 | A | 3/1997 | Catlin | |
| 5,839,459 | A | 11/1998 | Bisby | |
| 6,019,111 | A * | 2/2000 | Gillies | 134/138 |
| 6,450,185 | B1 * | 9/2002 | Sallinen | 134/138 |

* cited by examiner

*Primary Examiner*—Michael Barr
*Assistant Examiner*—Jason Heckert
(74) *Attorney, Agent, or Firm*—Maccord Mason PLLC

(57) ABSTRACT

A paint roller includes a spindle adapted to hold a rotatable cylindrical paint pad, and an arm connecting the spindle to a handle. A semi-cylindrical cover curves about the roller's spindle. A liquid manifold is integral with the cover to deliver a curtain of liquid to the paint roller for washing the cylindrical pad. The liquid manifold is made up of a tubular section having a hollow interior, a closed lower end and an open upper end adapted for attachment to a hose, the section including a plurality of spaced, longitudinally aligned holes in communication with the interior, whereby liquid is capable of flowing from the tubular section upper end through the hollow interior for discharge through the holes. An adapter plate for adapting the paint roller cover, to cover all types of rollers including different length spindles or roller cages, is slidably attachable to the cover outer surface. The plate includes a plurality of elongated and spaced notches extending inwardly from the outside edge, wherein the width of the notches is sized to receive the connecting arm of the roller.

20 Claims, 11 Drawing Sheets

ROLLER AND PAINTBRUSH CLEANING KIT

This application is a continuation-in-part of pending patent application Ser. No. 10/370,899, filed Feb. 20, 2003, now abandoned which claims the benefit of Provisional Application Ser. No. 60/359,211, filed Feb. 21, 2002.

BACKGROUND OF THE INVENTION (1) Field of the Invention

The present invention relates to an apparatus for cleaning paint from paint rollers and paintbrushes, and in particular to a roller and paintbrush cleaning kit that can be easily manufactured and compactly packaged for retail sale. The invention also relates to quick clean-up paint roller and the individual tools used to clean rollers and paintbrushes.

(2) Description of the Prior Art

Heretofore, removal of paint, especially latex paint, from paint rollers or paintbrushes has usually been performed by placing the roller or brush under a faucet and massaging the roller or brush with the fingers. This procedure, in addition to being messy and time consuming, normally leaves some of the paint in the roller or brush. Devices have been purposed in which the roller or brush is placed in housing and cleaned by pumping water through the housing. Designs so far purposed have met with little commercial acceptance.

Thus, there is a need for simple, mess-free, efficient and economical devices for cleaning paint from paint rollers and paint brushes. In addition, there is a need for a kit that includes such tools that can be compactly stored and displayed for retail sale.

SUMMARY OF THE INVENTION

This need is addressed by the present invention, which is comprised of paint roller cleaner and paintbrush cleaner tools that are attachable to a source of water, such as a faucet or spigot. The kit that includes these tools may further include a bucket or other container, and a hose to connect the tools to the water source.

The paintbrush cleaning tool is in the form of a comb-like apparatus having a hollow handle with a proximal end that is connectable to a hose, and a plurality of outwardly projecting teeth that can be drawn through the brush bristles. A plurality of holes are positioned in the handle in line with, and preferably adjacent to, the base of the teeth to project jets of water generally along the axis of the teeth, and thereby contact paint within the brush while the teeth are drawn through the brush bristles. Preferably, the tool teeth extend transversely from the axis of the paintbrush cleaner tool handle. The paint brush cleaning tool may also include a paint roller scraper in the configuration of a blade with a semi-circular cut-out section, that can be drawn along a roller to remove excess paint prior to cleaning with the paint roller cleaning tool.

The paint roller cleaning tool is comprised of a tubular member having a proximal end connectable to a hose, and a closed distal end. An attachment clip is at the proximal end of the tubular member for use in attaching the roller cleaning tool to a container. This clip may also be used as a handle, it being understood that the term "clip" as used herein is intended to define an arm with a proximal end attached to the tool and a free distal end that is useful as an attachment clip and/or as a handle. The clip may extend downward and/or outwardly and, in some configurations may extend upwardly. A series of spaced holes are axially aligned along the tubular member, with the radius of the holes preferably being at an angle, e.g., of approximately 180° to 270°, measured clockwise, relative to the clip. Thus, water directed into the interior of the tubular member exits through the holes as a pressurized curtain of water. Preferably, the water curtain is angled downwardly, e.g., at an angle of about 0° to 20°, preferably about 15°.

The above tools may be hand-held during use. Preferably, however, the paint roller and paintbrush cleaning tools are conveniently used with a container that collects the water, and also holds the paint roller tool during use. This container, which may be a conventional 5 gallon bucket, preferably has a depth greater than the roller to be cleaned, and preferably a diameter at the bottom of the bucket greater than the lengths of the tools. Other containers, such as a utility sink, trash can, etc., can also be used. The container may also include a handle that can be positioned to support the container at an angle during use, allowing the tainted water to be discharged from the container. Alternatively, the container can be used in an upright position and turned upside down to empty. The container may also have a hole with a removable cap in the bottom to drain water. The preferred containers are buckets of the type that are stackable, one within the other for shipment and retail display, with a space of about 4 inches between the outer surface of the bottom of one bucket and the inner surface of the bottom of the immediately lower bucket.

A hose may also be provided to attach each of the tools to a faucet or spigot. Generally, the hose will be a rubber or plastic hose having a fitting at one end adapted for attachment to a faucet or spigot, and the fitting at the other end being adapted for attachment to the paintbrush and paint roller tools. In a preferred embodiment, the fittings at both ends are female fittings. It will be understood, however, that one of the fittings may instead by male fittings, such as on a garden hose, or both may be male fittings, depending on the design of the tool attachment ends. The hose may also include a handle or grip to facilitate its use when the tools are used as hand-held tools.

When shipped and displayed, or for storage, the hose can be rolled up and inserted into the bottom of the bucket along with the tools. The rolled hose and tools should fit within the "dead" space between the stacked buckets, so that the kits can be compactly displayed in the retail establishment. The tools can also be sold without a bucket for use with the purchaser's own container. The tools can also be sold with or without the hose.

Thus, it is an objective of the present invention to provide a paintbrush cleaning tool having an elongated handle with a hollow interior, a closed proximal end, an open distal end adapted for attachment of a hose, a plurality of teeth extending transversely from the handle adjacent the distal end, the teeth having base ends attached to the handle and outer ends, and holes at the base of the teeth extending into the interior of the handle, whereby water is capable of flowing from the handle proximal end through the hollow interior and from the holes along the teeth.

It is a further objective of the invention to provide a paint roller cleaning tool having a tubular section with a hollow interior, a closed lower end and an open upper end adapted for attachment of a hose, the section including a plurality of spaced, longitudinally aligned holes in communication with the hollow interior, whereby water is capable of flowing from the tubular section upper end through the hollow interior for discharge through the holes, and an attachment clip extending outwardly from the tubular section.

It is another objective of the invention to provide a kit for use in cleaning paintbrushes and paint rollers that includes the above paintbrush cleaning tool and paint roller cleaning tool, and optionally a bucket or other container and a hose, the two tools and the hose being storable for shipment and display within the bucket.

Yet, another objective of the invention is to provide a quick clean-up paint roller. The quick clean-up paint roller comprises a spindle or roller cage adapted to hold a rotatable cylindrical paint pad, and an arm connecting the spindle to a handle. A paint roller cover is attachable to the paint roller and is used to catch paint drips and splatter as the roller is used to apply paint to a wall, etc. The roller cover includes a shield that is generally semi-cylindrical in shape being curved about a central axis in line with the spindle. The shield has an inner surface, an outer surface, front and back edges and side edges. A liquid manifold integral with the cover is positioned to deliver a curtain of liquid to the paint roller for washing paint from the cylindrical pad after painting. The liquid manifold comprises a tubular section having a hollow interior, a closed lower end and an open upper end adapted for attachment to a hose. The tubular section includes an elongated discharge opening or single slot in communication with the interior of the cover, whereby liquid is capable of flowing from the tubular section upper end through the hollow interior for discharge through the elongated discharge opening. In one embodiment, the elongated discharge opening is segmented to form a plurality of spaced, longitudinally aligned holes in communication with the cover's interior.

Moreover, the cover is universally adaptable to fit over different length spindles or roller cages, different diameter roller connecting arms, different nap thicknesses on the roller paint pads and different shaped roller frames. The cover includes a plurality of handle connector arm stops to stop the handle at predetermined angular positions relative to the shield. While these stops can be outward projecting pegs or fins from the arm side of the shield, it is preferred that the stops be included on an adapter plate for adapting the paint roller cover to fit over different length spindles. It is also preferred that the adapter plate is slidably attachable to the shield outer surface. The adapter plate has top and bottom surfaces connected by inside, outside and side edges.

The handle connector arm stops on the adapter plate is preferably a plurality of elongated and spaced notches extending inwardly from the plate outside edge, wherein the width of the notches is sized to receive the paint roller's connecting arm. In one embodiment, the plurality of notches includes a first notch located adjacent the shield side edge corresponding to a right-hand position, a second notch located adjacent the other shield side edge corresponding to a left-hand position and a third notch located between the first and second notches, the third notch corresponding to a cleaning position. The width of the notches is such that each notch will receive different gauges or diameters of connecting arms.

The adapter plate also includes a track that is attached to the shield outer surface for holding the plate bottom surface against the shield outer surface. In one embodiment, the track comprises a pair of rails attached to the shield outer surface. The rails are spaced apart by a distance substantially equal to the width of the adapter plate and extend adjacent to and parallel the shield front and back edges to a length substantially equal to the length of the adapter plate.

Moreover, it is preferred that the shield outer surface includes a patch of indexed grooves or bumps located between the rails, wherein the grooves or bumps are sized and spaced to match a corresponding patch of indexed grooves or bumps located on the plate bottom surface to frictionally hold the adapter plate at set increments along the rails. It is also preferred that a snap lock such as a T-snap be integral to the shield outer surface between the rails. The snap lock receives a mating member on the adapter plate's bottom surface during the manufacturing assembly process, and prevents the adapter plate from being slid too far one way or the other.

In another embodiment, a detachable cover handle clips over the cover shield. The detachable cover handle is hollow and includes an open proximal end to receive an extension pole for painting ceilings, etc. The cover's adapter plate is unnecessary when the cover includes the detachable cover handle. Therefore, it is envisioned that one embodiment of the paint cover shield can be sold without the adapter plate.

Further still, the shield includes a paint extraction tool that is releasibly attachable to the shield outer surface. The paint extraction tool has a handle and blade, wherein the blade has a semi-circular outer edge sized to receive a substantial arc-length of the circumference of the cylindrical paint pad. Gripper tabs extending outwardly from the shield outer surface holds the paint extraction tool onto the paint roller cover when the paint extraction tool is not in use.

The recommended first step in cleaning paint from the quick clean-up roller is to use the manual tabs on the adapter plate to slide the adapter plate inwardly such that the paint roller arm is not captured by any of the plate's notches. Next, the roller arm is rotatably positioned in line with the plate notch that corresponds to the cleaning position. The plate is then slid outwardly until the roller arm is captured in the cleaning position. The indexed friction lock on the bottom side of the adapter plate in conjunction with the rails and friction lock between the rails on the top surface of the paint cover hold the adapter plate secure. Next the paint extractor tool is removed from the gripper tabs on the top surface of the paint roller cover, and is used to scrape excess paint off the paint roller pad. Normally, the paint roller will be held with one hand to a position over a paint container while the other hand is used to scrape the blade of the paint extraction tool down the length of the paint roller pad, thereby scrapping excess paint off the pad and into the paint container. The roller pad can be rotated and scrapped until the desired amount of excess paint is removed. Then the paint extractor tool is washed and returned to the gripper tabs on the top of the paint roller cover.

The quick clean-up roller is then prepared for washing by attaching one end of a hose to a faucet or spigot, and the other end of the hose to the upper end of the liquid manifold adapted for attachment to a hose. The faucet or spigot is turned on to wash the roller cover and pad. Water then enters the liquid manifold adjacent to the body of the cover. As water pressure builds within the liquid manifold, jets of water exit the plurality of holes in the liquid manifold tubular section creating a curtain of water that impacts generally tangentially against the roller pad causing the roller pad to spin, exposing all parts of the roller pad and interior of the roller cover to the curtain of water. The jets of water depart at an angle relative to the liquid manifold such that the various sized roller pads will spin when impacted. Centrifugal force resulting from the spinning, in conjunction with the force of the water curtain, forces the paint off of the roller pad and cover. Once the paint pad and roller are sufficiently clean of paint, the spigot or faucet is turned off, and the hose is removed from the liquid manifold.

Other objectives of the invention will become apparent to one skilled in the art upon reading the following detailed description of the invention, taken with the drawings.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
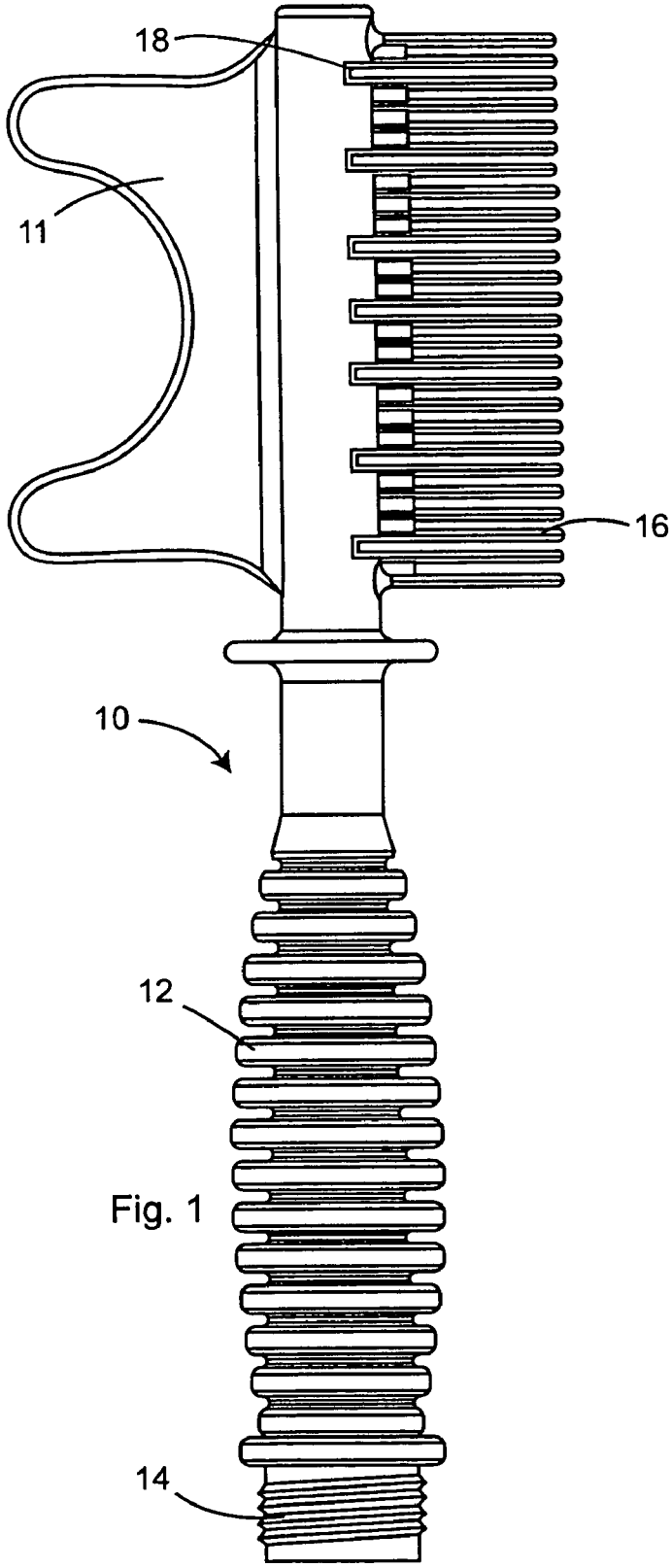
FIG. 1 is a side view of the paintbrush cleaning tool.
Figure 2:
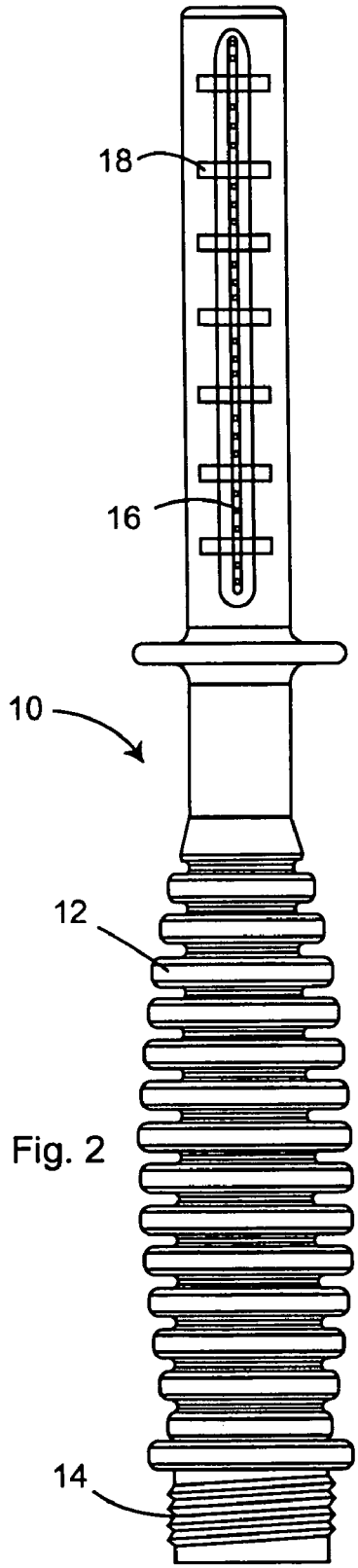
FIG. 2 is a frontal view of the paintbrush cleaning tool.

As best illustrated in FIGS. 1 and 2, paintbrush cleaning tool, generally 10, is comprised of hollow handle 12 having a hose connection 14 at its proximal end, and a plurality of parallel teeth 16 extending transversely from the distal end on handle 12. Handle 12 includes a plurality of holes 18 inline with and adjacent to the base of teeth 16. A paint roller scraper 11 comprised of a blade with a cut-out section having a diameter slightly greater than a paint roller extends outwardly from the opposite side of handle 12 for use in scraping excess paint from rollers prior to cleaning.

Figure 6:
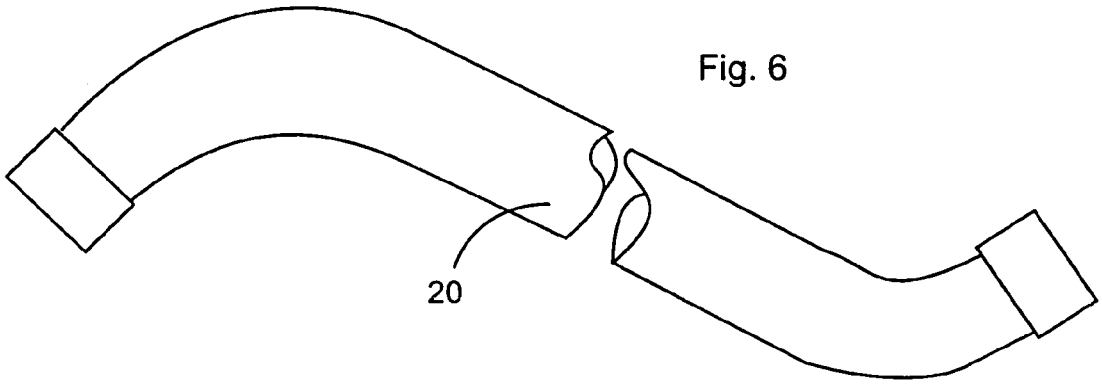
FIG. 6 is a hose with female fittings at each end.

When used, a hose 20, shown in FIG. 6, is connected to connection 14 and water flows through the interior of handle 12 and at increased pressure through holes 18 along pathways generally parallel to or inline with teeth 16. Teeth 16 are combed through the bristles of the brush to be cleaned, so that the jets of water from holes 18 deeply clean between the bristles.

Figure 3:
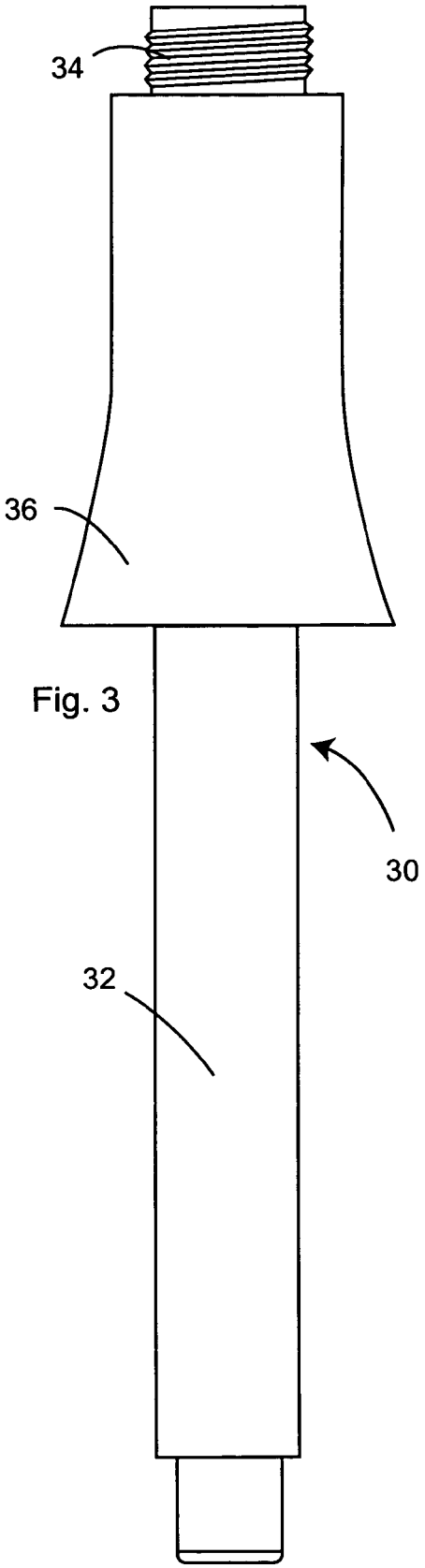
FIG. 3 is a rear view of the paint roller cleaning tool.
Figure 4:
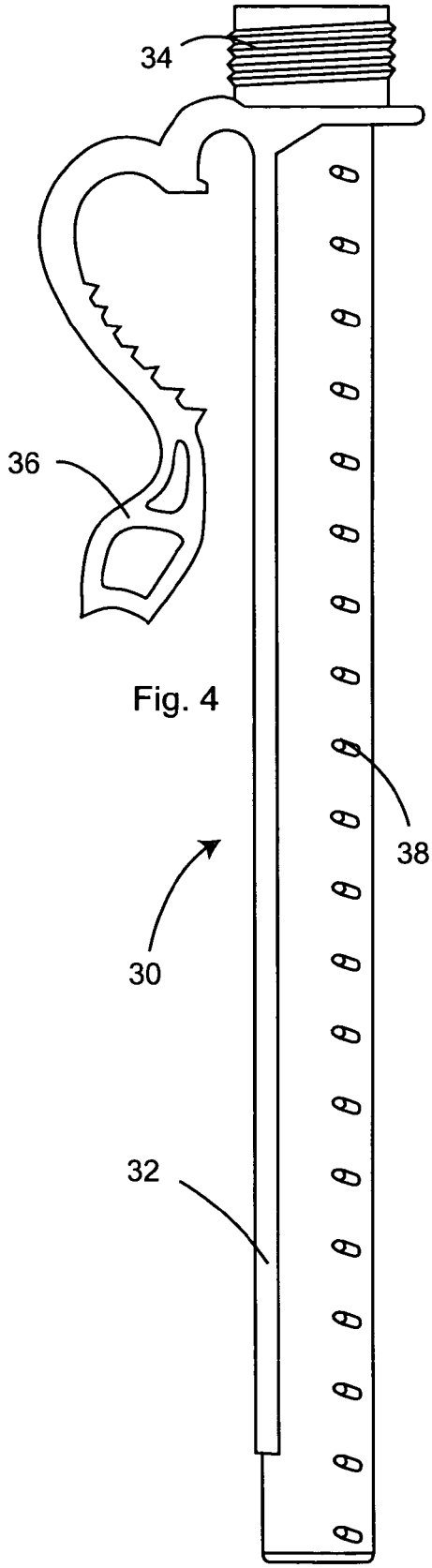
FIG. 4 is a side view of the paint roller cleaning tool.
Figure 5:
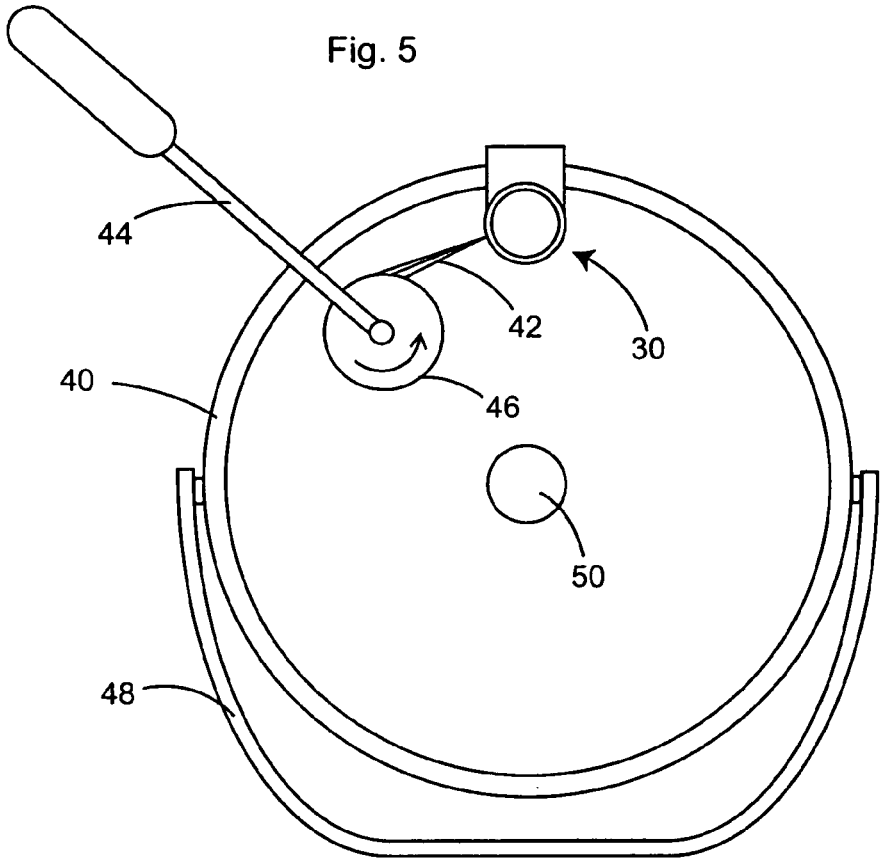
FIG. 5 is a top view of the paint roller cleaning tool positioned in a bucket.

As illustrated in FIGS. 3 and 4, paint roller cleaning tool, generally 30 is comprised of a tubular wand 32 having a hose connection 34 at its proximal end, and a closed distal end. Clip 36 is integrally molded at the proximal end of tubular wand 32. Wand 32 includes a plurality of spaced holes 38 axially aligned along wand 32 with the radius of the holes preferably being at an angle relative to clip 36. When in use, as illustrated in FIG. 5, wand 32 is inserted into bucket 40, and held in place with clip 36. Hose 20 is connected to connection 34 and to a water source. Water flows through wand 32 and exits through holes 38 to form a pressurized water curtain 42. A paint roller handle 44 is laid over the side of bucket 40 so that the paint roller 46 is positioned so that water curtain 42 impacts generally tangentially against roller 46, preferably on the side of the roller adjacent the inner wall of bucket 40, causing roller 46 to spin, exposing all parts of the roller to curtain 42. This centrifugal force resulting from the spinning, in conjunction with the force of the water curtain, forces the paint off of the roller nap.

Figure 7:
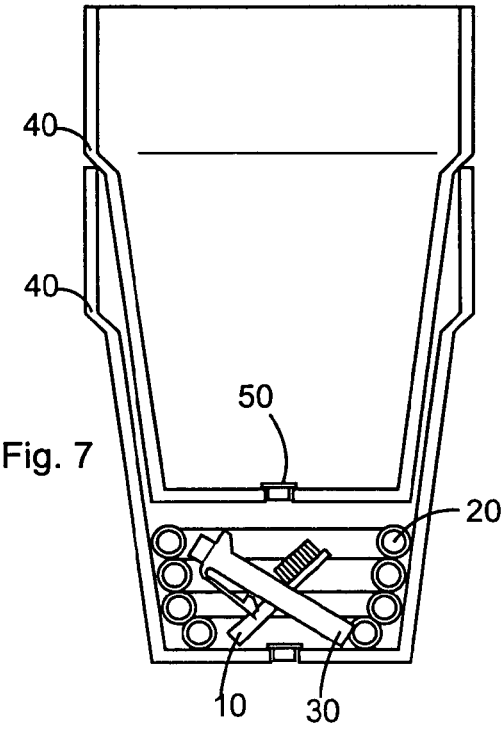
FIG. 7 is a sectional side view of a kit with the tools and hose stored in the bottom of a stacked bucket.
Figure 8:
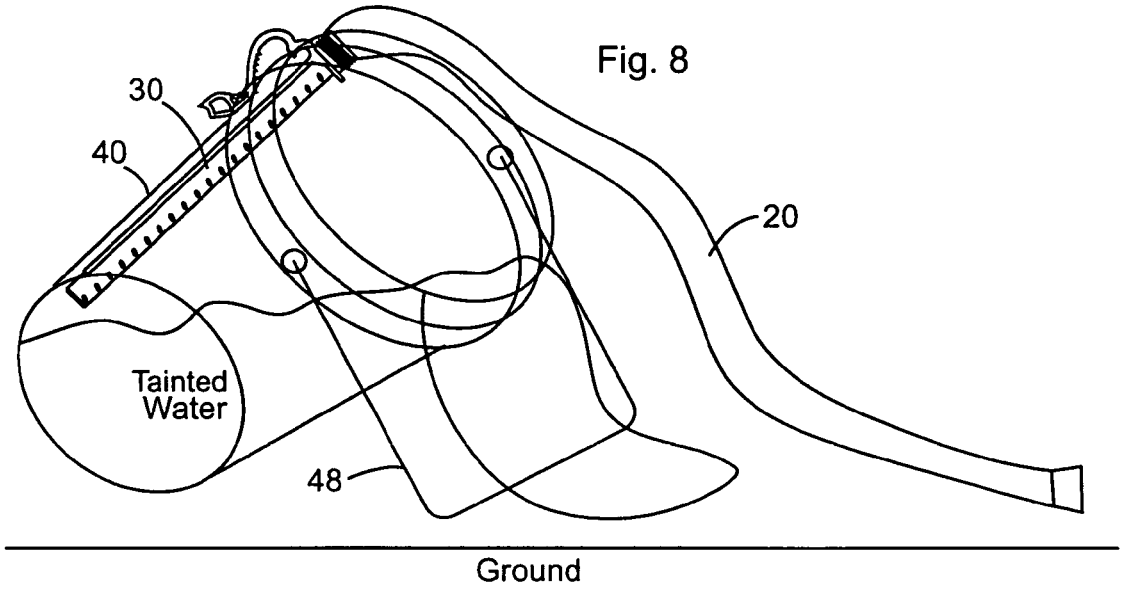
FIG. 8 is a perspective view of the paint roller cleaning system positioned for use.

As illustrated in FIG. 7, tools 10 and 30, and hose 20, can be conveniently housed in the bottom of bucket 40. When shipped or displayed, or stored, buckets 40 can be stacked as shown. FIG. 8 illustrates paint roller cleaning tool 30 mounted in bucket 40, which is supported at an angle on bucket handle 48. In this position, tainted water can overflow from bucket 40 during cleaning of the paint roller. Tainted water must discharge from bucket 40 to allow roller 46 to continue to spin for the cleaning process. Alternatively, bucket 40 can be used in the upright position and turned upside down after use to pour out the tainted water, or capped drain hole 50 can be opened to drain the water.

Figure 9:
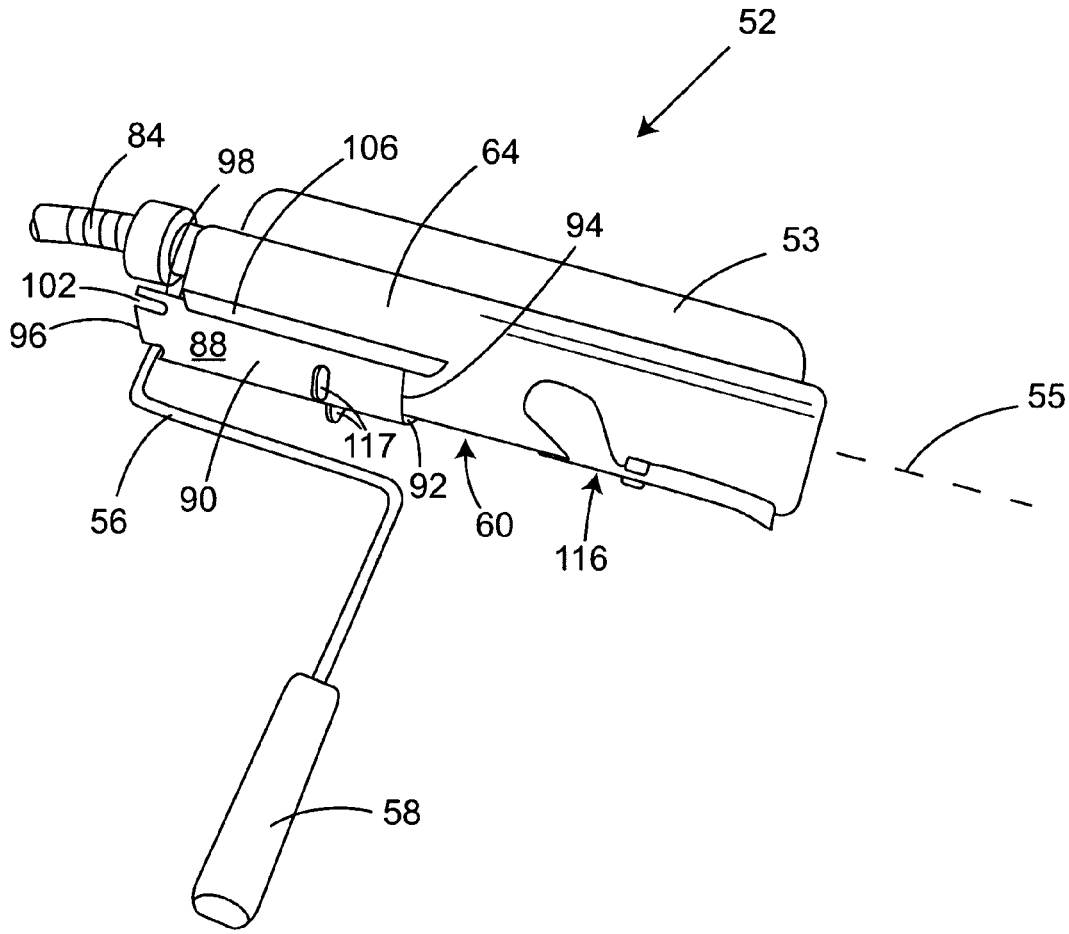
FIG. 9 is a perspective view of a quick clean-up paint roller according to one embodiment of the invention.
Figure 10:
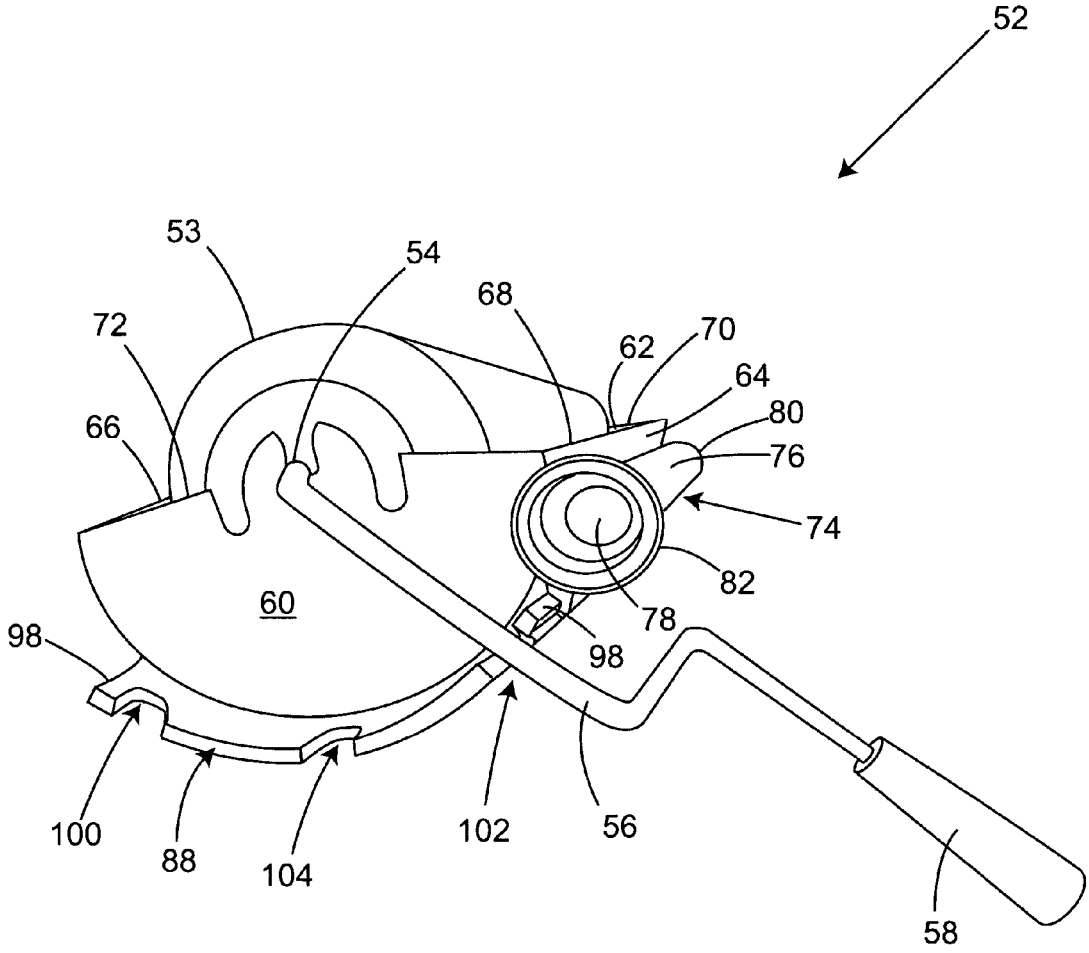
FIG. 10 is a perspective view of the quick clean-up roller of FIG. 9 as seen from one side.

FIGS. 9 and 10 show yet another embodiment of the paint roller cleaning tool. A quick clean-up paint roller, generally 52, is comprised of a spindle 54 adapted to hold a rotatable cylindrical paint pad 53, and an arm 56, which connects spindle 54 to a handle 58. A paint roller cover 60 is attachable to paint roller 52, and is used to catch paint drips and splatter as roller 52 is used to apply paint to a wall, etc. Roller cover 60 has a shield that is generally semi-cylindrical in shape being curved about a central axis 55. The shield of cover 60 has an inner surface 62, an outer surface 64, a front edge 66 and a back edge 68 along with side edges 70 and 72.

Figure 11:
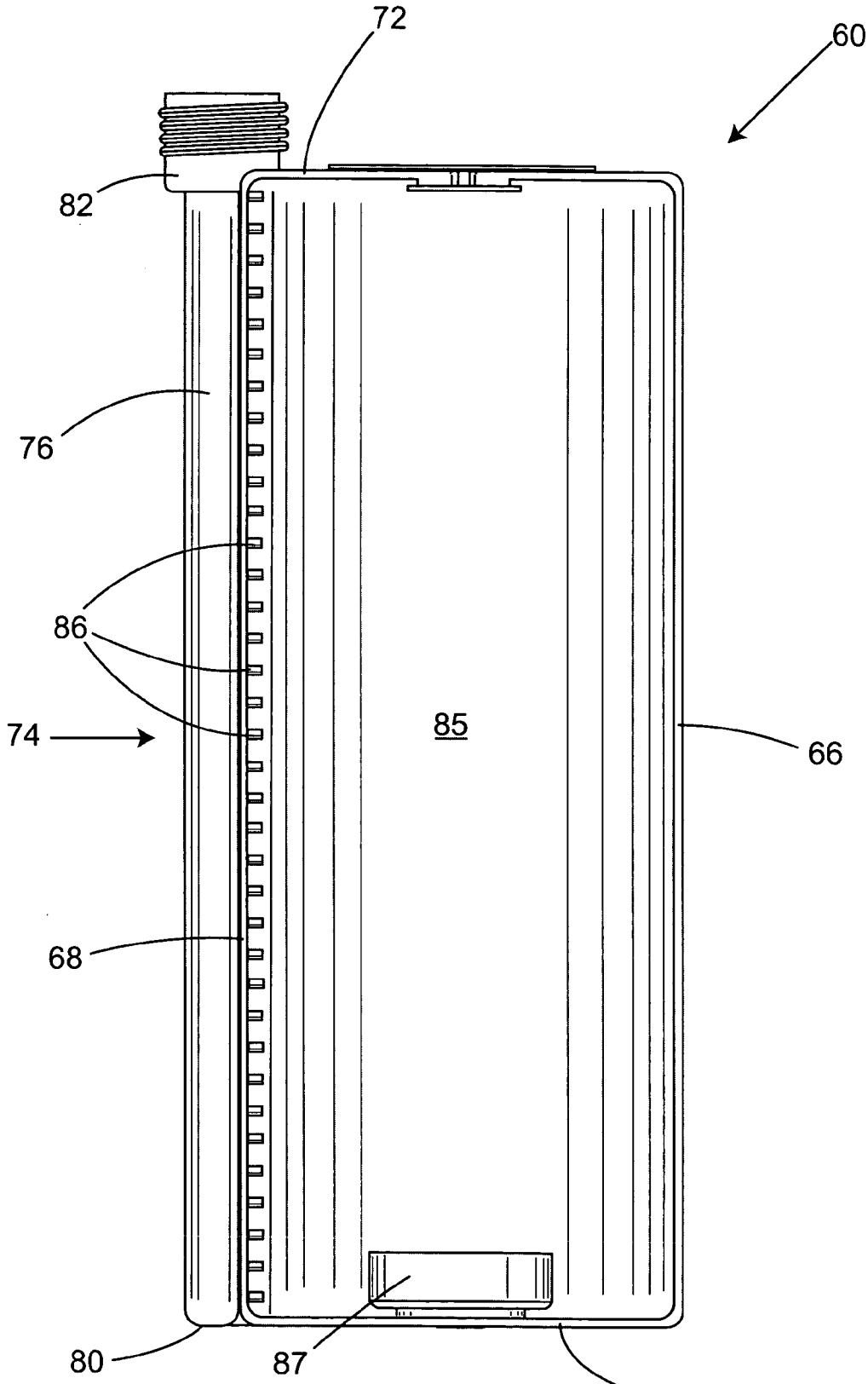
FIG. 11 is a plan view of the interior of the paint roller cover.

A liquid manifold 74 is preferably integral with cover 60 and is adjacent to shield back edge 68. It is also preferred that manifold 74 is positioned to deliver a curtain of liquid to roller pad 53 for washing pad 53 and cover 60 after painting. Liquid manifold 74 comprises a tubular section 76 having a hollow interior 78, a closed lower end 80, and an upper end 82 adapted for attachment to a hose 84. FIG. 11 shows the shield interior 85 of cover 60, wherein tubular section 76 includes a plurality of spaced, longitudinally aligned holes 86 in communication with shield interior 85, whereby liquid is capable of flowing from tubular section upper 82 through hollow interior 78 for discharge through holes 86. The integral structure of paint roller cover 60 lends itself to efficient and cost effective injection molding manufacturing. FIG. 11 also shows a cap 87, which is placed on the distal end of a roller pad or roller cage (not shown), and is used to rotatably hold the distal end of a roller pad when the roller is in use.

Looking back at FIGS. 9 and 10, cover 60 is universally adaptable to fit over different length spindles or roller cages, different diameter roller connecting arms, different nap thicknesses on the roller paint pads and different shaped roller frames. An adapter plate 88 for adapting roller cover 60 to fit over different length spindles is slidably attachable to shield outer surface 64. Adapter plate 88 has a top surface 90 and a bottom surface 92 connected by an inside edge 94, an outside edge 96 and side edges 98.

Adapter plate 88 also includes a plurality of elongated and spaced notches extending inwardly from plate outside edge 96, wherein the width of the notches is sized to receive the diameter arm 56. In the embodiment shown in FIGS. 9-14, the plurality of notches includes a first notch 100 located adjacent shield side 66 corresponding to a right-hand position, a second notch 102 located adjacent shield side edge 68 corresponding to a left-hand position and a third notch 104 located between notches 100 and 102 corresponding to a cleaning position.

Cover 60 also includes a track that is attached and preferably integral with shield outer surface 64 for holding plate bottom surface 92 against shield outer surface 64. In the embodiment of FIGS. 9-14, the track comprises a pair of rails 106 integral with shield outer surface 64. Rails 106 are spaced apart by a distance substantially equal to the width of adapter plate 88, and extend parallel with and adjacent to shield front and back edges 66 and 68.

Figure 12:
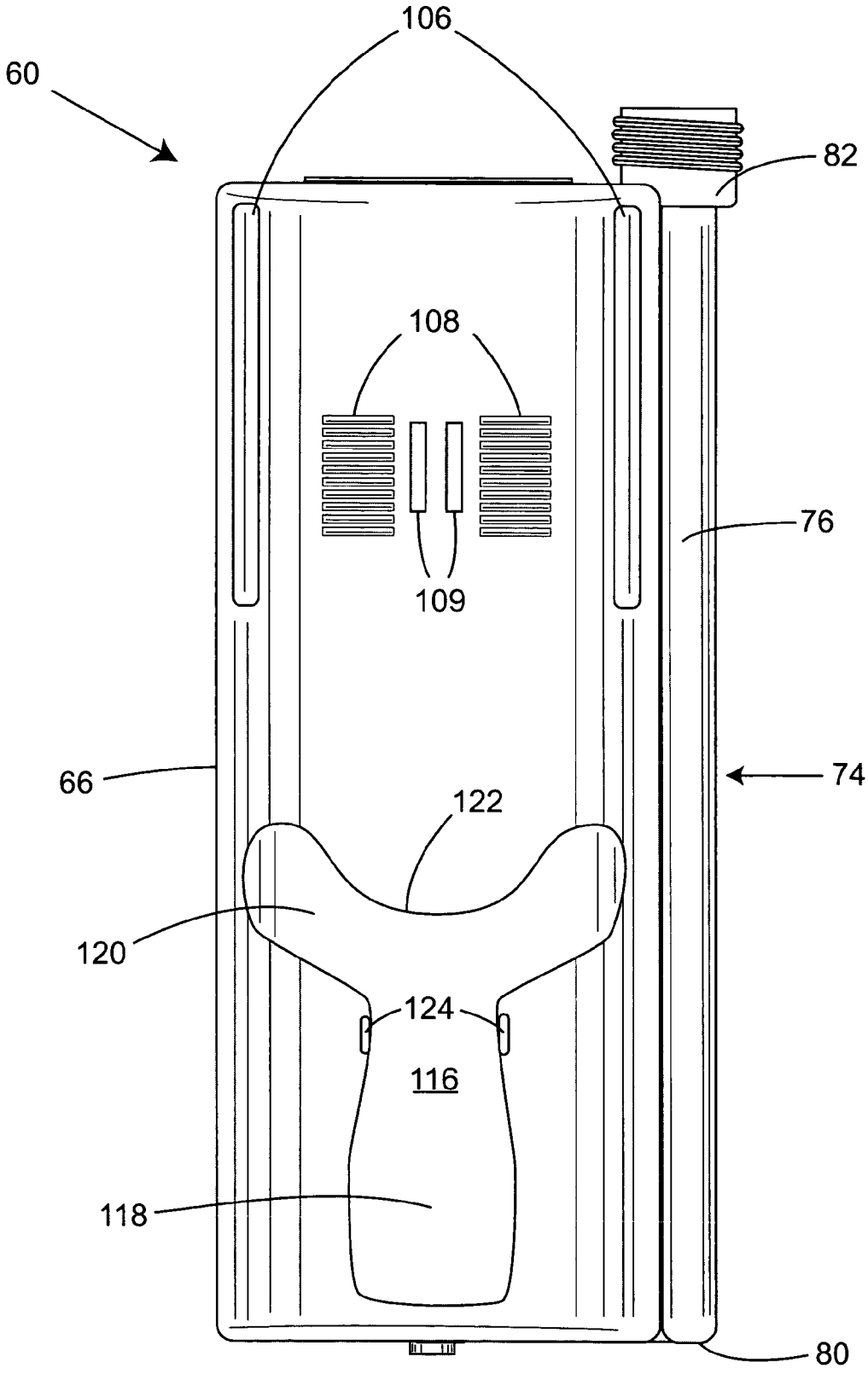
FIG. 12 is a plan view of the top of the paint roller cover.
Figure 13:
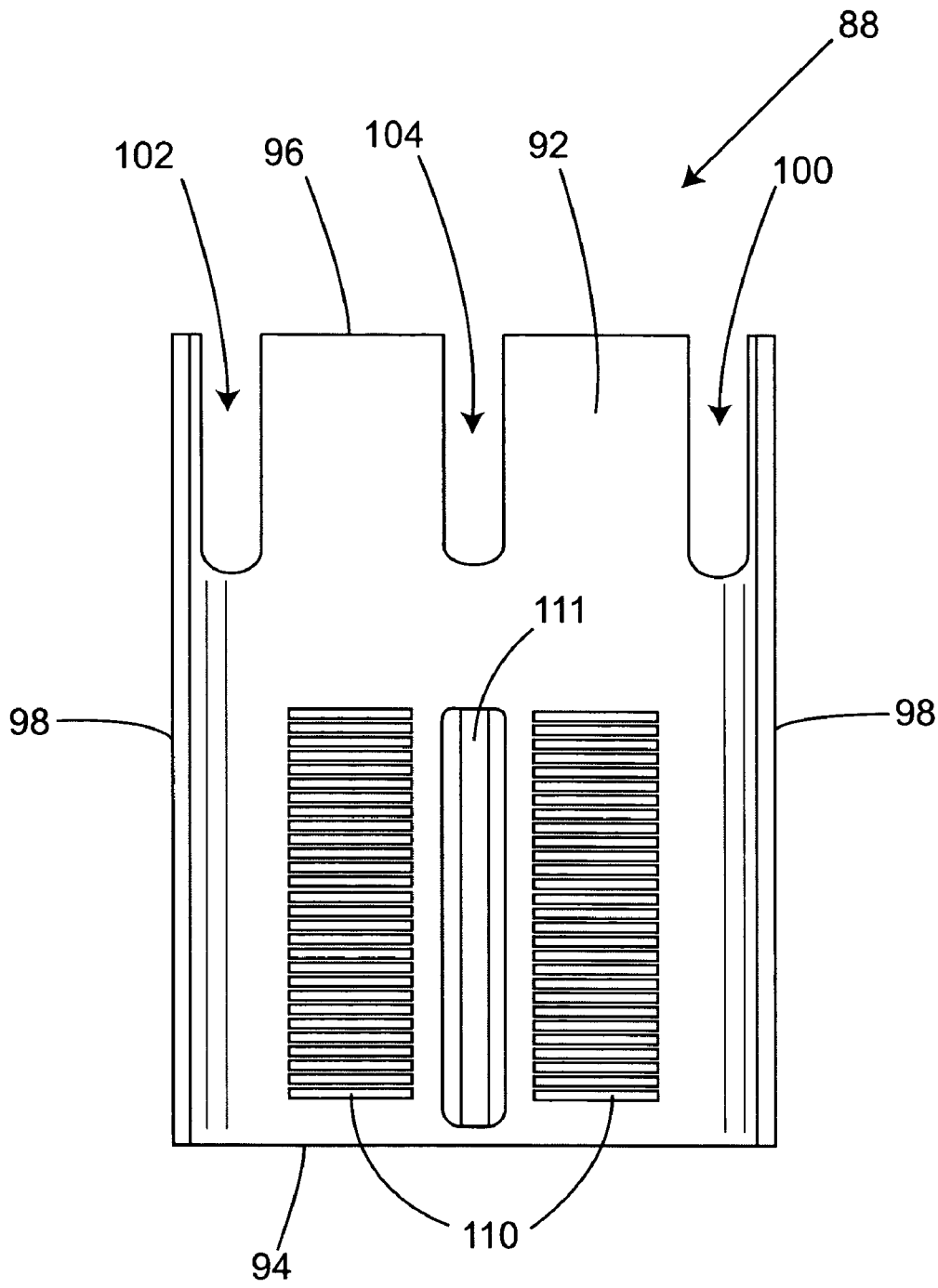
FIG. 13 is a plan view of the bottom surface of the adapter plate.

FIG. 12 shows the cover 60 with adapter plate 88 removed to show an indexed friction lock 108 used to hold adapter plate 88 at set increments along rails 106. Indexed friction lock 108 can be either indexed grooves or indexed bumps that are sized to match a corresponding friction lock 110 located on plate bottom surface 92, shown in FIG. 13.

A T-snap 109 central to friction lock 108 fastens adapter plate 88 to cover 60 by way of a mating member, which is preferably a monorail 111. T-snap 109 also serves as a permanent stop to prevent plate 88 from being slid too far one way or the other. Plate 88 is typically snapped onto roller cover 60 during the manufacturing assembly process.

Figure 14:
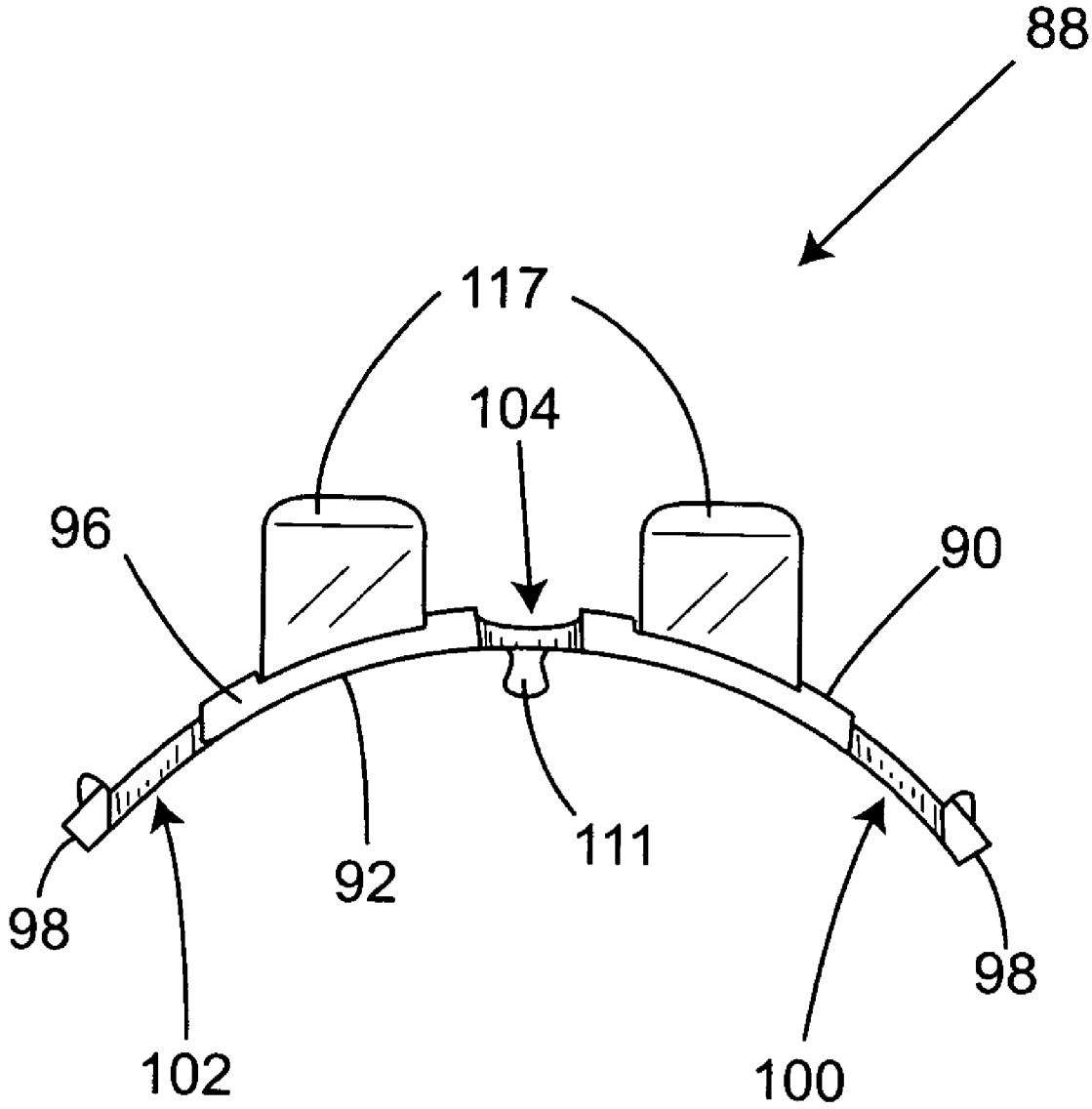
FIG. 14 is a side view of the adapter plate.

FIG. 14 shows adapter plate 88 as seen by looking directly into notches 100, 102, and 104 located in plate outside edge 96. As shown in FIG. 14, adapter plate bottom surface 92 generally matches the contour of shield outer surface 64 of cover 60. Manual tabs 117 project outward from plate top surface 90, and are used to manually slide adapter plate 88 along track rails 106. Monorail 111 slidably fastens adapter plate 88 to cover 60.

Referring back to FIG. 12, cover 60 also includes a paint extraction tool 116 for removing excess paint from roller pad 53 before washing. Paint extraction tool has a handle 118 and a blade 120, wherein blade 120 has a semi-circular edge 122, sized to receive a substantial arc-length of the circumference of roller pad 53. When attached to cover 60, gripping tabs 124 that project outwardly from shield outer surface 64 holds paint extractor tool 116.

Figure 15:
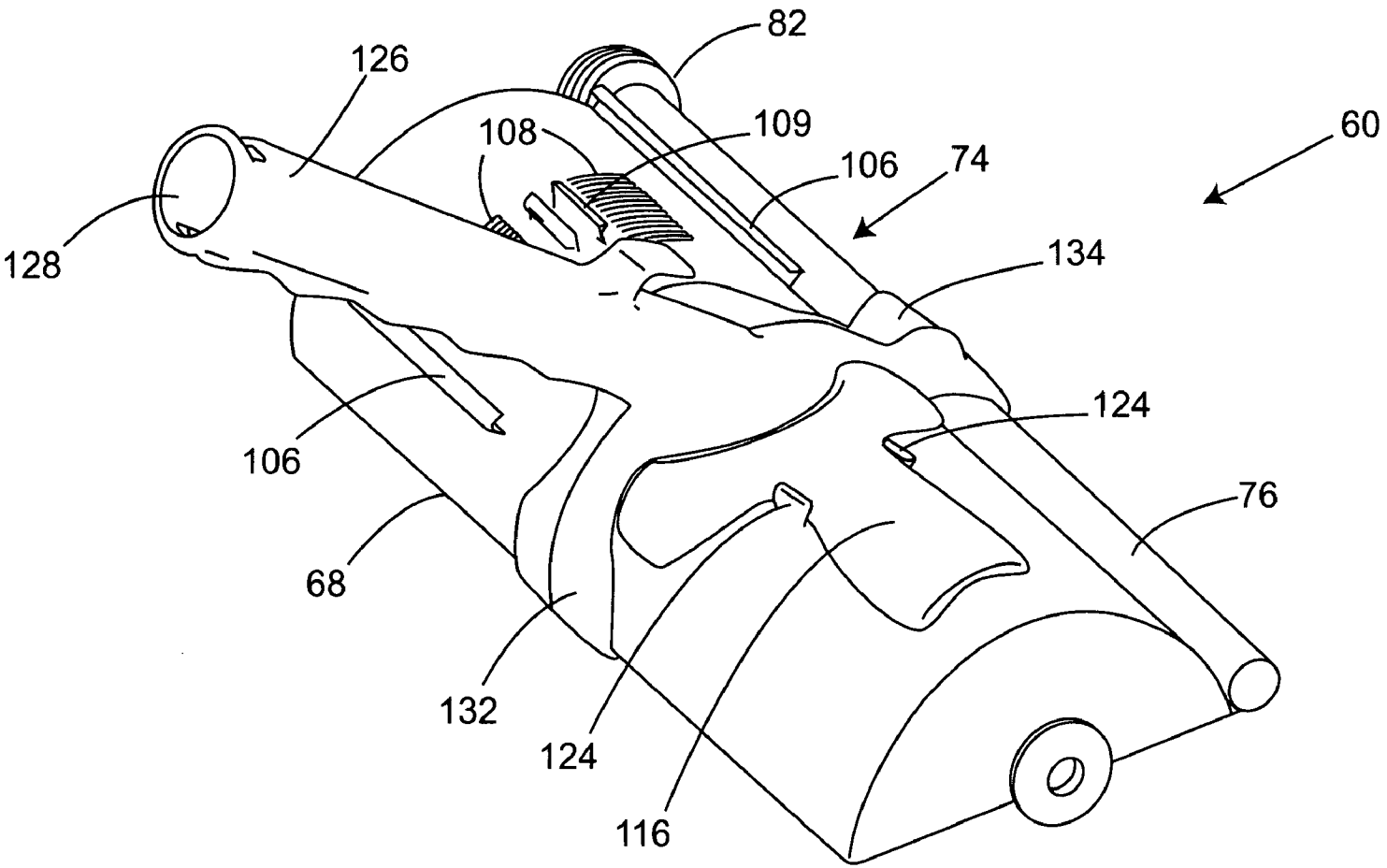
FIG. 15 is a perspective view of the quick clean-up roller having an attachable handle with a hollow end for receiving an extension pole.

FIG. 15 shows a detachable cover handle 126 that is attachable to the middle of cover 60. Handle 126 has a hollow proximal end 128 for receiving the end of an extension pole (not shown). Handle 126 also has a distal end 130 that includes a rearward curving brace 132 that follows the curvature of cover 60, and ends as a fold around cover back edge 68. A forward brace 134 extends forwardly from distal end 130, and follows the curvature of cover 60 ending as a partial wrap around a substantial portion of the circumference of tube 76 of liquid manifold 74. Since detachable cover handle 126 is located in the middle of cover 60 both right and left-handed users can use it. Thus, whenever detachable cover handle 126 is used with cover 60, there is no need for an adapter plate such as adapter plate 88 shown in the previous figures. Therefore, it is possible to manufacture the handle cover combination shown in FIG. 15 in a one step injection molding process, which brings down the cost to a sellable price.

Certain modifications and improvements will occur to those skilled in the art upon a reading of the foregoing description. For example, the depth of notches 100, 102, and 104 can be manufactured just deep enough so that arm 56 is held by plate 88, without allowing outside plate edge 96 to protrude past roller arm 56. This way, the ends of paint cover 60 can fit within a typical paint tray. It should be understood that all such modifications and improvements have been deleted herein for the sake of conciseness and readability but are properly within the scope of the following claims.

What is claimed is:

1. A quick clean-up paint roller, comprising:

a) a spindle adapted to hold a rotatable cylinder, and an arm connecting said spindle to a handle;

b) a paint roller cover having a generally semi-cylindrical shape curved about said spindle, said cover having an inner surface, an outer surface, front and back edges and side edges;

c) a liquid manifold integral with said cover to deliver a curtain of liquid to said paint roller for washing said cylindrical pad, said liquid manifold comprising a tubular section having a hollow interior, a closed lower end and an open upper end adapted for attachment to a hose, said section including an elongated discharge opening in communication with said interior, whereby liquid is capable of flowing from said tubular section upper end through said hollow interior for discharge through said elongated opening; and d) an adapter plate slidably attachable to said cover outer surface, said plate having top and bottom surfaces connected by inside, outside and side edges, said plate having a plurality of elongated and spaced notches extending inwardly from said outside edge, wherein the width of said notches is sized to receive said connecting arm.

2. The quick clean-up roller of claim 1, wherein said elongated discharge opening is comprised of a plurality of spaced, longitudinally aligned holes.

3. The quick clean-up paint roller of claim 1, wherein said plurality of notches is a first notch located adjacent said shield side edge corresponding to a right-hand position, a second notch located adjacent said other shield side edge corresponding to a left-hand position and a third notch located between said first and second notches, said third notch corresponding to a cleaning position.

4. The quick clean-up paint roller of claim 1, further including a track attached to said shield outer surface for holding said plate bottom surface against said cover outer surface.

5. The quick clean-up paint roller of claim 4, wherein said track comprises a pair of rails attached to said cover outer surface, said rails being spaced apart by a distance substantially equal to the width of said adapter plate and extend parallel along said shield front and back edges from adjacent one of said cover side edges to a length substantially equal to the length of said adapter plate.

6. The quick clean-up paint roller of claim 5, wherein said cover outer surface includes a patch of indexed grooves located between said rails, said grooves being sized and spaced to match a corresponding patch of indexed bumps located on said plate bottom surface to frictionally hold said adapter plate at set increments along said rails.

7. The quick clean-up paint roller of claim 5, wherein said cover outer surface includes a patch of indexed bumps located between said rails, said bumps being sized and spaced to match a corresponding patch of indexed grooves located on said plate bottom surface to frictionally hold said adapter plate at set increments along said rails.

8. The quick clean-up paint roller of claim 1, further including a paint extraction tool having a handle and blade, said blade having a semi-circular outer edge sized to receive a substantial arc-length of the circumference of said cylindrical pad, said paint extraction tool being releasibly attachable to said semi-cylindrical shield outer surface.

9. A universally adaptable paint roller cover for allowing left-hand or right-hand use of a paint roller, and for providing quick clean-up of said paint roller after use, said paint roller having a handle, a cylindrical pad rotatable about a spindle, and an arm connecting said spindle to said handle, said universally adaptable paint roller cover comprising:

a) a generally semi-cylindrical shield curved about a central axis, said shield having an inner surface, an outer surface, opposing ends and front and back edges;

b) a liquid manifold attached to said shield, said manifold comprising a tubular section having a hollow interior, a closed lower end and an open upper end adapted for attachment to a hose, said section including a plurality of spaced, longitudinally aligned holes in communication with said interior, whereby liquid is capable of flowing from said tubular section upper end through said hollow interior for discharge through said holes; and c) an adapter plate for adapting said paint roller cover to fit over different length spindles, said adapter plate being slidably attachable to said shield outer surface, said plate having top and bottom surfaces connected by inside, outside and side edges, said plate having a plurality of elongated and spaced notches extending inwardly from said outside edge, wherein the width of said notches is sized to receive said connecting arm.

10. The universally adaptable paint roller cover of claim 9, wherein said plurality of notches is a first notch located adjacent said shield side edge corresponding to a right-hand position, a second notch located adjacent said other shield side edge corresponding to a left-hand position and a third notch located between said first and second notches, said third notch corresponding to a cleaning position.

11. The universally adaptable paint roller cover of claim 9, further including a track attached to said shield outer surface for holding said plate bottom surface against said shield outer surface.

12. The universally adaptable paint roller cover of claim 11, wherein said track comprises a pair of rails attached to said shield outer surface, said rails being spaced apart by a distance substantially equal to the width of said adapter plate and extend adjacent to and parallel said shield front and back edges to a length substantially equal to the length of said adapter plate.

13. The universally adaptable paint roller cover of claim 12, wherein said shield outer surface includes a patch of indexed grooves located between said rails, said grooves being sized and spaced to match a corresponding patch of indexed bumps located on said plate bottom surface to frictionally hold said adapter plate at set increments along said rails.

14. The universally adaptable paint roller cover of claim 12, wherein said shield outer surface includes a patch of indexed bumps located between said rails, said bumps being sized and spaced to match a corresponding patch of indexed grooves located on said plate bottom surface to frictionally hold said adapter plate at set increments along said rails.

15. The universally adaptable paint roller cover of claim 9, further including a paint extraction tool having a handle and blade, said blade having a semi-circular outer edge sized to receive a substantial arc-length of the circumference of said cylindrical pad, said paint extraction tool being releasibly attachable to said semi-cylindrical shield outer surface.

16. The universally adaptable paint roller cover of claim 9, wherein said generally semi-cylindrical shield and said liquid manifold is made in one piece from injection molding plastic.

17. A quick clean-up paint roller including an adaptable paint splatter shield, said paint roller comprising:

a) a spindle adapted to hold a rotatable cylindrical paint pad, and an arm connecting said spindle to a handle;

b) a paint roller cover having a shield with a generally semi-cylindrical shape curved about said spindle, said shield having an inside surface, an outside surface, a front edge and a back edge;

c) a liquid manifold integral with said cover to deliver a curtain of liquid to said paint roller for washing said cylindrical pad, said liquid manifold comprising a tubular section having a hollow interior, a closed lower end and an open upper end adapted for attachment to a hose, said section including a plurality of spaced, longitudinally aligned holes in communication with said interior, whereby liquid is capable of flowing from said tubular section upper end through said hollow interior for discharge through said holes; and d) an adapter plate for adapting said paint roller cover to fit over different length spindles, said adapter plate being slidably attachable to said shield outside surface, said plate having top and bottom surfaces connected by inside, outside and side edges, said plate having a plurality of elongated and spaced notches extending inwardly from said outside edge, wherein the width of said notches is sized to receive said connecting arm.

18. The universally adaptable paint roller cover of claim 17, wherein said plurality of notches is a first notch located adjacent said shield side edge corresponding to a right-hand position, a second notch located adjacent said other shield side edge corresponding to a left-hand position and a third notch located between said first and second notches, said third notch corresponding to a cleaning position.

19. The universally adaptable paint roller cover of claim 17, further including a track attached to said shield outer surface for holding said plate bottom surface against said cover outer surface.

20. The universally adaptable paint roller cover of claim 19, wherein said track comprises a pair of rails attached to said shield outer surface, said rails being spaced apart by a distance substantially equal to the width of said adapter plate and extend adjacent to and parallel with said shield front and back edges to a length substantially equal to the length of said adapter plate.

* * * * *